United States Patent [19]

Zanelli

[11] 3,983,781

[45] Oct. 5, 1976

[54] EJECTOR FOR TRANSPORT OF AN EXPLOSIVE

[75] Inventor: Franco Zanelli, Vevey, Switzerland

[73] Assignee: Dr. Ing. Mario Biazzi Soc. An., Vevey, Switzerland

[22] Filed: Mar. 21, 1975

[21] Appl. No.: 560,685

[30] Foreign Application Priority Data

Apr. 9, 1974 Switzerland ..... 4953/74

[52] U.S. Cl. ..... 86/1 R; 264/3 R

[51] Int. Cl.[2] ..... C06B 21/00

[58] Field of Search ..... 86/1, 20; 264/3 R

[56] References Cited

UNITED STATES PATENTS 3,678,140 7/1972 Adams et al. ..... 264/3 R

*Primary Examiner*—Stephen J. Lechert, Jr.

*Attorney, Agent, or Firm*—Arthur B. Colvin

[57] ABSTRACT

An ejector for bringing an explosive liquid into an aqueous emulsion for transport along a pipe has a water-injection nozzle leading into an explosive-intake chamber, and a diffuser of progressively outflaring section extending from said chamber coaxial to the nozzle. An explosive inlet duct leads tangentially into said chamber which is defined by converging conical surfaces whereby the explosive is gradually accelerated along a helical path of progressively decreasing cross-sectional area up to a zone of contact with water from the injection nozzle.

4 Claims, 2 Drawing Figures

EJECTOR FOR TRANSPORT OF AN EXPLOSIVE

The invention relates to devices for bringing explosives into an aqueous emulsion, suspension or liquid for transport.

To be transported, explosives such as nitroglycerine, nitroglycol, or nitroglycerine/nitroglycol mixtures are usually brought into the form of an aqueous emulsion, suspension or mixture by means of apparatus called giffard injectors, ejectors, or water-jet pumps. The operating characteristics of such known apparatus are often not well known and they may generate great variations of energy in a very short time, causing detonation of the carried explosive when the sensitivity threshold is exceeded.

These abrupt variations of energy cause the compression of bubbles of gas which are generally present in the transported liquid. This may generate localized raising of the temperature and detonation of the explosives.

In particular, abrupt variations of the energy are produced at the following locations.

a. Input of the explosive in the intake chamber. At the beginning of intake, the explosive arrives radially at high speed and makes a violent impact with the wall of the intake chamber, causing a strong dynamic overpressure before flowing axially towards a diffuser.

b. The zone of contact of the explosive with the carrying water. During normal operation, the speed of the explosive is low and, upon contact with the water, it increases abruptly.

c. Zones involving an abrupt change in the inner profile of the diffuser. At these locations, "unsticking" of the emulsion from the wall of the diffuser causes an anormal cavitation which produces abrupt pressure changes.

Also, the internal construction of these apparatus does not enable a sufficiently intense emulsification of the two phases to ensure stability of the emulsion during delivery along a long path.

The invention aims to provide an ejector for the transport of an explosive liquid in the form of an aqueous emulsion which enables the above-mentioned drawbacks of known ejectors to be eliminated.

According to the invention, such an injector comprises an explosive-intake chamber provided with an inlet duct for the explosive, a water-injection nozzle leading into said chamber, and a diffuser extending from said chamber coaxial to said nozzle and of which the cross-sectional passageway area increases progressively from upstream to downstream, in which the intake chamber has a generally circular section and the inlet duct leads tangentially into the intake chamber, the cross-sectional passageway area of the intake chamber decreasing progressively along a path of flow of the explosive whereby the explosive is progressively accelerated in said chamber and takes the form of a helicoidal current up to the zone of contact with the water at the outlet of the injection nozzle.

The intake chamber may be defined by two cones, an inner one and an outer one, whose circular bases are concentric or eccentric, the axis of the inner cone coinciding with the axis of the injection nozzle.

Alternatively, the intake chamber is defined by an inner cone and an outer surface of generally conical shape whose section, in a plane perpendicular to the axis of the inner cone and passing through the axis of the explosive-inlet duct, is spiral.

Preferably, there is no abrupt change in section in the intake chamber and diffuser, and the profile of the diffuser is such that the variation of the kinetic energy of the emulsion, as a function of time, is reduced to its minimum value, this profile also being such that it avoids any unsticking of a vein of fluid from the wall of the diffuser in the conditions of operation previewed for the ejector.

The accompanying drawings show, by way of example, an embodiment of the invention. In the drawings.

Figure 2:
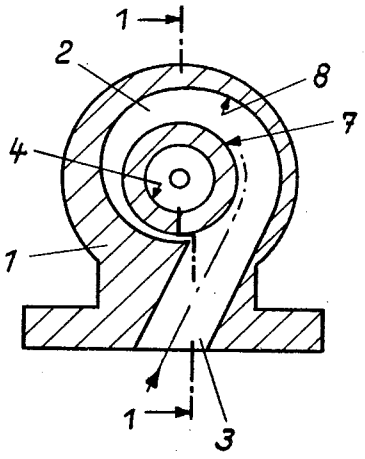
FIG. 2 is a transverse cross-section taken along line 2—2 of FIG. 1.
Figure 1:
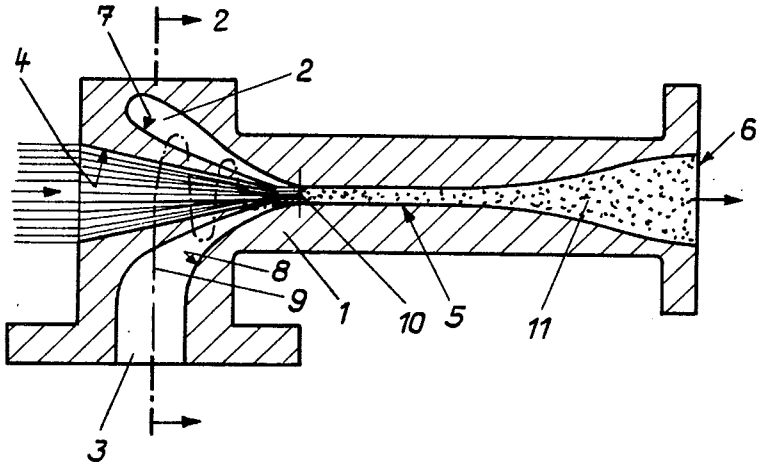
FIG. 1 is an axial cross-section of an ejector according to the invention.

The ejector 1 shown serves for the transport, in the form of an aqueous emulsion, of an explosive liquid such as nitroglycerine or nitroglycol and includes an intake chamber 2 provided with an inlet duct 3 for the explosive liquid. A water injection nozzle 4 leads into the intake chamber 2 coaxial with a diffuser 5 of which the cross-sectional passageway area progressively increases from upstream to downstream, to an outlet 6.

The intake chamber 2 is defined by an inner cone 7 forming the outer wall of the nozzle 4 and by an outer surface 8 of generally conical shape and whose section, in the plane of FIG. 2, is of spiral shape. The inlet duct 3 leads tangentially into chamber 2 of which the cross-sectional passageway area decreases progressively in the direction of flow of the explosive indicated by dot-dash line 9. The water injection nozzle 4 leads into chamber 2 in the proximity and upstream of the narrowest passageway section 10.

The diffuser 5 extends downstream of section 10 and is of great length in relation to the diameter of section 10. The diffuser 5 has no abrupt change of its cross-sectional passageway area, but this sectional area increases progressively from the zone of contact of section 10 up to the outlet 6 of the diffuser.

In operation, the explosive entering tangentially into intake chamber 2 does not undergo an impact against the wall of this chamber, but moves spirally and takes the form of a helicoidal current progressively increasing in speed over a relatively long path.

The progressive reduction of the sectional area of intake chamber 2 enables the explosive to reach, in the zone of contact with the transporting water, a sufficiently high speed without undergoing an abrupt increase of speed, which avoids the danger of explosion.

Finally, the small diameter and the great length of the diffuser 5, in which an emulsion 11 is formed, advantageously enables production of an emulsion so fine that it has a sufficient stability to withstand long transports in pipes.

What is claimed is:

1. In an ejector for bringing an explosive liquid into the form of an aqueous emulsion, suspension or mixture, for transport, comprising an explosive-intake chamber provided with an inlet duct for the explosive, a water-injection nozzle leading into and having an outlet in said chamber, and a diffuser extending from said chamber coaxial to said nozzle and of which the cross-sectional passageway area increases progressively from upstream to downstream, the improvement in which the intake chamber has a generally circular section and the inlet duct leads tangentially into the intake chamber, the intake chamber defining a path of flow of the explosive and having cross-sectional passageway area which decreases progressively along said path of flow whereby the explosive is progressively accelerated in said chamber and takes the form of a helicoidal current up to a zone of contact with the water at said outlet of said injection nozzle.

2. An ejector according to claim 1, in which the intake chamber is defined by a first cone disposed inside a second cone, the axis of the first cone coinciding with the axis of the injection nozzle.

3. An ejector according to claim 1, in which the intake chamber is defined by a cone disposed within a surface of generally conical shape whose section, in a plane perpendicular to the axis of said cone and passing axially through the explosive-inlet duct, is spiral.

4. An ejector according to claim 1, in which there is no abrupt change of section, its profile being such that the variation of the kinetic energy of the emulsion, as a function of time, is reduced to its minimum value, this profile also being such that it avoids any unsticking of a vein of fluid from the wall of the diffuser in the conditions of operation previewed of the ejector.

* * * * *